United States Patent [19]

Wingard

[11] Patent Number: 4,868,577

[45] Date of Patent: Sep. 19, 1989

[54] MULTIBAND TELEVISION/COMMUNICATIONS ANTENNA

[76] Inventor: Jefferson C. Wingard, 107 Wiltshire Ct., Anderson, S.C. 29621

[21] Appl. No.: 137,829

[22] Filed: Dec. 23, 1987

[51] Int. Cl.[4] ..... H01Q 1/32

[52] U.S. Cl. ..... 343/713; 343/725

[58] Field of Search ..... 343/7.3, 7.5, 725, 899, 343/900, 714, 729, 828, 853

[56] References Cited

U.S. PATENT DOCUMENTS

| | | | |
|---|---|---|---|
| 2,555,857 | 6/1951 | Nelson et al. | 343/705 |
| 4,095,229 | 6/1978 | Elliott | 343/899 |
| 4,635,066 | 1/1987 | St. Clair et al. | 343/725 |

FOREIGN PATENT DOCUMENTS

| | | | |
|---|---|---|---|
| 0649685 | 10/1962 | Canada | 343/705 |

*Primary Examiner*—Rolf Hille
*Assistant Examiner*—Doris J. Johnson
*Attorney, Agent, or Firm*—Cort Flint

[57] ABSTRACT

A unitary, multiband and dual polarity mobile antenna (A) is disclosed for vehicles and the like which includes a television antenna (B) having a horizontally polarized radiation pattern and a 2-way communications antenna (C) having a vertically polarized radiation pattern. A null current point (50) is created on communications antenna (C) by a phasing coil (34) which is intersected by a horizontal plane (52) in which television antenna (B) lies. This reduces cross-coupling, cross-polarization, and interference between the two antenna during operation. Horizontal television antenna (B) includes a J-folded, generally boomerang shaped, curved antenna configured to have a radiating element (20) and a half radiating element (22). These elements together form a third radiating element providing operation at three resonant frequencies.

15 Claims, 2 Drawing Sheets

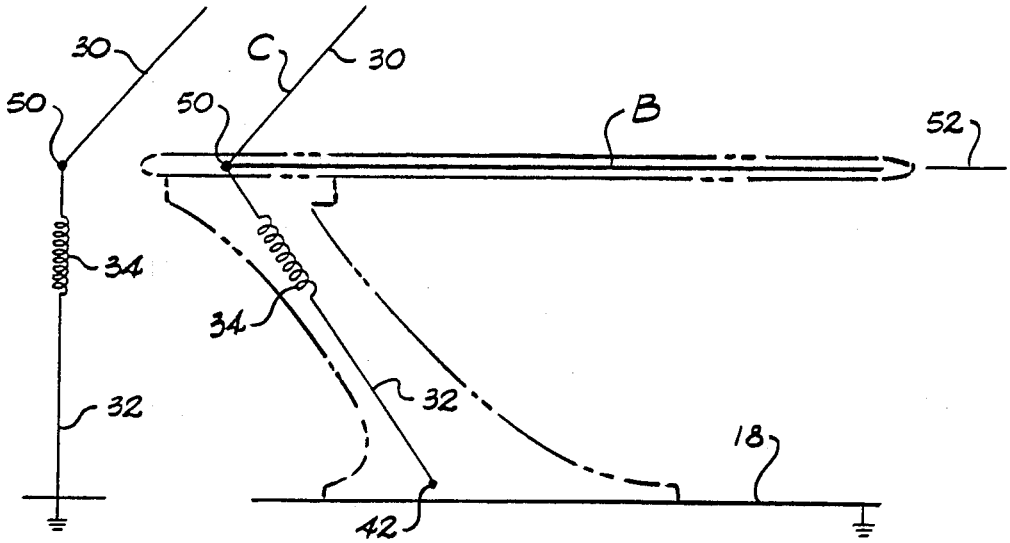
Fig. 4a
Fig. 4
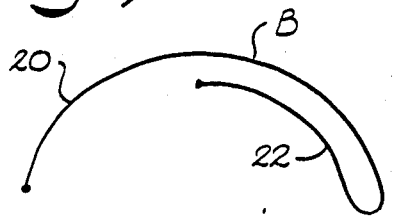
Fig. 6
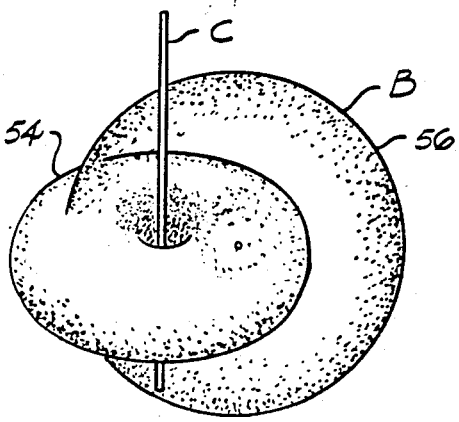
Fig. 7
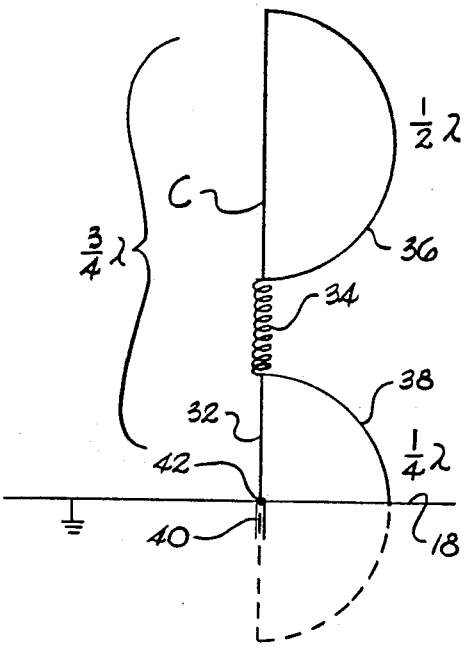
Fig. 5

MULTIBAND TELEVISION/COMMUNICATIONS ANTENNA

BACKGROUND OF THE INVENTION

The invention relates to multiband antennas and particularly to a multiband unitary antenna unit for receiving television signals and for transmitting and receiving 2-way communication signals like in mobile cellular telephones.

With the increasing popularity of cellular telephones, a need has arisen for antennas to be used on automobiles and the like vehicles. Previously, television antennas have been provided for automobiles in a winged, ornamental housing as shown in Des. Pat. No. 245,778 wherein a dipole antenna folded in the shapes of both wings. Cellular telephone antennas have typically included rectilinear elements commonly referred to as 3 dB antennas. With the use of a television and a cellular phone in one vehicle, the need for multiple antennas on the vehicle has arisen. The mounting of more than one antenna on a vehicle gives a cluttered appearance. While it is desirable to eliminate multiple antennas on a vehicle, it is not always simple or practical from a technical and aesthetic view point.

A folded antenna consisting of a plurality of dipoles connected end to end in a generally J-shaped pattern, commonly referred to as a folded Franklin antenna, has been known and used typically for business (emergency, police, etc.) and marine bands and vertically polarized.

Accordingly, an important object of the invention is to provide a multi-element antenna capable of operating at multiple bands from a compact unitary housing for vehicular use.

Another object of the invention is to provide a multiband antenna unit which may be used for receiving television and 2-way communication.

Another object of the invention is to provide a compact vehicle antenna capable of efficiently operating in the television and cellular telephone frequency bands in a unitary housing without interference from one another.

SUMMARY OF THE INVENTION

The above objectives are accomplished according to the present invention by providing a unitary housing which houses a television antenna having a horizontally polarized radiation pattern and a 2-way communications antenna having a vertically polarized radiation pattern. The communications antenna includes a first radiating element connected to a second radiating element by a phasing coil. A current null point is formed adjacent the phasing coil. The two antennas are incorporated in the housing so that a horizontal plane in which the television antenna lies intersects the current null point of the communications antenna so the cross-coupling and interference is reduced. Preferably, the television antenna is provided by a folded generally J-shaped antenna which creates three radiating elements radiating at three resonant frequencies for effective reception of VHF and UHF television signals. The communications antenna is in the form of a cellular telephone antenna which transmits and receives. The second radiating element of the cellular telephone antenna extends outwardly from a boomerang shaped upper portion of the housing in which the horizontal television antenna lies. A compact unitary multiband antenna is provided having plural antennas effectively operating at dual polarity.

DESCRIPTION OF THE DRAWINGS

The construction designed to carry out the invention will hereinafter be described, together with other features thereof.

The invention will be more readily understood from a reading of the following specification and by reference to the accompanying drawings forming a part thereof, wherein an example of the invention is shown and wherein:

FIG. 4 is a side elevation of the multiband antenna with the housing shown in phantom lines;

FIG. 4A is a schematic illustration of the cellular antenna element and current null current with intersection of the horizontally polarized television antenna;

FIG. 5 is a schematic view illustrating a theoretical configuration and wave length of a cellular phone antenna for use with a multiband antenna according to the invention;

FIG. 6 is a schematic view illustrating the size and configuration of a television antenna for use in a multiband antenna according to the invention; and FIG. 7 is an illustration of theoretical radiation patterns of the multiband antenna of the present invention.

DESCRIPTION OF A PREFERRED EMBODIMENT

Figure 1:
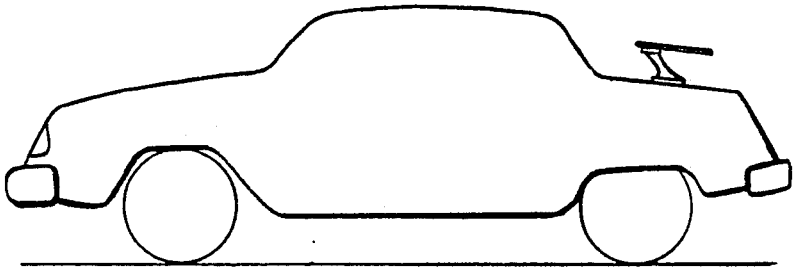
FIG. 1 is a side elevation illustrating a vehicle with a multiband antenna constructed in accordance with the present invention.
Figure 2:
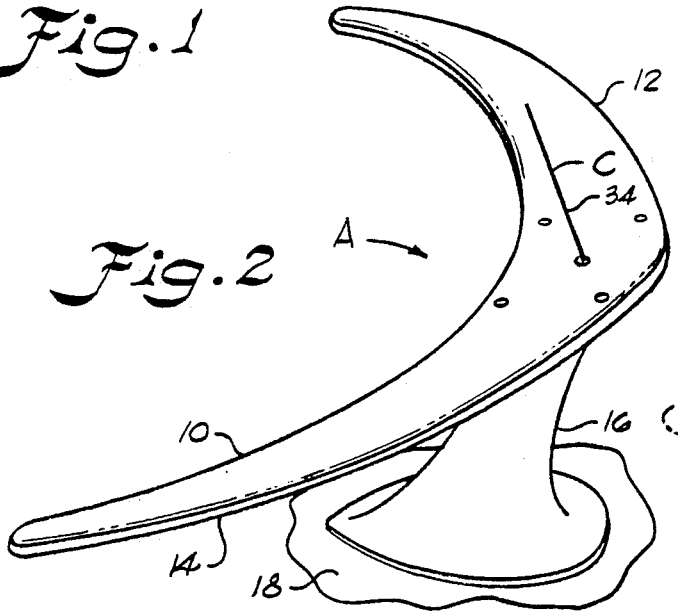
FIG. 2 is a perspective view of the multiband antenna.

Referring now in more detail to the drawings, a multiband antenna is designated generally at A which includes a housing 10 in the form of a winged antenna housing having a widened horizontal portion consisting of a pair of wings 12, 14 in a boomerang shape supported on a narrow pedestal base 16. Base 16 may be fastened directly onto a vehicle such as a trunk 18 of an automobile.

In accordance with the invention, multiband antenna A includes a television receiving antenna B and a 2-way communication antenna C for cellular telephone reception and transmission. Television antenna B includes antenna elements constructed from any suitable conductor such as round copper or aluminum wire. Preferably, antenna B is arranged in a folded Franklin configuration which results in multiple resonant frequencies, and is carried in housing 10 in a horizontal plane for horizontal polarization. As can best be seen in FIGS. 3 and 6, there is a first radiating antenna element 20 and a second, half radiating antenna element 22. Each of these elements acts individually and also together in phase. Element 20 operates individually at a first resonant frequency in a high VHF band of generally 172 to 214 megahertz for reception of VHF channels 8–13. Element 22 operates at a second resonant frequency generally within a 410 to 900 megahertz band for UHF reception of channels 14–83. In the UHF mode of operation, the antenna acts as a long wire antenna resulting in some gain. Elements 20 and 22 operate together as a third radiating element, at a third resonant frequency within a low VHF band for reception of channels 2–7, generally between 54 and 88 megahertz. A feed point 24 of antenna B is connected to a coaxial cable 26 which may be routed to the interior of the vehicle for connection to a television amplifier or television receiver 28, as can best be seen in FIG. 3.

Figure 3:
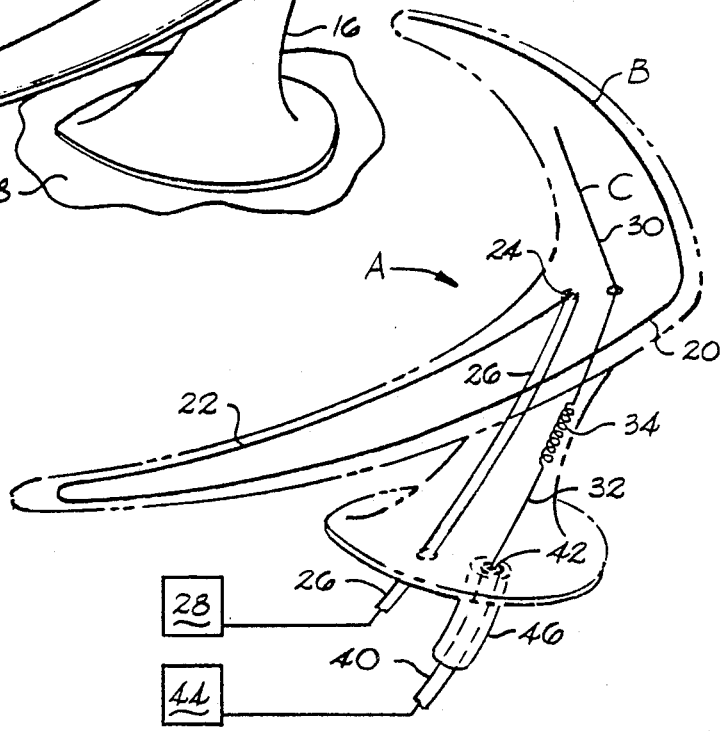
FIG. 3 is a perspective view of the multiband antenna with the housing shown in phantom lines to illustrate multiple antenna elements for a unitary multiband antenna according to the invention.

Multiband antenna A includes a fourth, monopole radiating element 30 and a fifth, monopole radiating element 32 of 2-way communication antenna C. The 2-way antenna is preferably a cellular phone antenna element C. The 2 monopole antennas 30,32 are connected by a phasing coil 34. Antenna elements 30 and 32 may be any suitable conductors such as copper or aluminum wire. Phasing coil 34, is of a suitable number of turns, diameter, and length, in order to achieve proper phasing between antenna elements 30 and 32. Radiating element 30 may be approximately 6" in length and may be made from copper or aluminum wire or other suitable conductive material. Element 30 extends at an angle of 0 to 30 degrees to vertical for effective vertical polarization. Radiating element 30 is half-wave antenna element which produces a half wave signal 36 (FIG. 5). Radiating element 32 may be approximately 3" long and a quarter-wave antenna element which produces a quarter wave signal 38. Phasing coil 34 also produces a full half-wave signal, the net effect of which places the half-wave and quarter-wave signals 36 and 38 in phase to produce a three-quarter wave antenna in phase for gain. Quarter wave element 32 has a nominal 50 ohm impedance designed to match the impedance of a coaxial cable 40 connected to antenna element C at a feed point 42. It will be noted that the vehicle 18 acts as a ground plane, and in this sense acts as a quarter wave antenna with element 32. Alternately, cable 40 may be provided with a coaxial sleeve when antenna A is mounted to vehicles having non-conductive bodies. Coaxial cable 40 is connected to a cellular telephone unit 44 inside the vehicle (FIG. 3).

In accordance with the invention, antennas B and C are enclosed in a compact unitary housing to provide multiband antenna A. Housing 10 is preferably formed from a nonconductive, plastic material. An important feature of multiband antenna A is that a current null point 50 of communication antenna C, created by phasing coil 34, is located within housing 10 with respect to the horizontal plane of television antenna B so that interference between antenna elements B and C is minimized. As can best be seen in FIG. 4, horizontal antenna element B is disposed in a horizontal plane 52 which intersects antenna C at current null point 50 so that both antennas may be accommodated in housing 10 without significant cross coupling, interaction, and interference. Antenna element B is a horizontally polarized and antenna element C is vertically polarized.

For purposes of illustration only, and not limitation, FIG. 7 illustrates generally a theoretical radiation pattern of antenna elements B and C. Antenna element C radiates a generally toroidal shaped, vertically polarized pattern 54 having its center about the generally vertical antenna. Antenna element B radiates a generally toroidal shaped, horizontally polarized pattern 56.

While a preferred embodiment of the invention has been described using specific terms, such description is for illustrative purposes only, and it is to be understood that changes and variations may be made without departing from the spirit or scope of the following claims.

What is claimed is:

1. A unitary multiband antenna for a vehicle having plural antennas operating at different frequencies and polarities comprising:

a housing adapted for mounting to said vehicle;

a television receiving antenna carried within said housing generally in a horizontal plane operating within a band of television frequencies, and said television antenna having a horizontally polarized radiation pattern;

a 2-way communications antenna for transmitting and receiving communication signals carried in a vertical plane by said housing having a vertically polarized radiation pattern; and said television antenna including a generally J-shaped configuration having a first element radiating on a high band of VHF frequencies, a second antenna element radiating in a band of UHF frequencies, and said first and second elements operating together as a third radiating element to produce radiation in a low band of VHF frequencies.

2. The apparatus of claim 1 wherein said communications antenna comprises:

a first vertically polarized, elongated, radiating element carried within said housing;

a second vertically polarized, elongated, radiating element carried by said housing extending from the exterior thereof; and a phasing coil connected between said first and second radiation elements for placing said first and second radiating elements in phase.

3. The antenna of claim 2 wherein said first radiating element produces a quarter wave signal and said second radiating element produces a half wave signal.

4. The antenna of claim 3 wherein said phasing coil produces a half wave signal out of phase with said first and second signals so that said communications antenna produces a net three-quarter wave length signal.

5. The antenna of claim 2 including a null current point created on said communications antenna by said phasing coil, and said television and communications antennas are carried by said housing with said television antenna in a horizontal plane that intersects said null current point of said communications antenna to minimize cross-coupling and interference between said antennas unitarily carried within said housing to provide a unitary multiband multi-element antenna.

6. The antenna of claim 1 wherein said television and communications antennas are carried by said housing with said television antenna in a horizontal plane that intersects a null current point in said vertical plane of said communications antenna to minimize cross-coupling and interference between said antennas unitarily carried within said housing to provide a unitary multiband multi-element antenna.

7. A unitary multiband vehicle antenna for receiving television signals and for receiving and transmitting communications signals in a composite antenna structure comprising:

a 2-way communication antenna for transmitting and receiving communications signals having a vertically polarized radiation pattern;

a television antenna for receiving television signals having a horizontally polarized radiation pattern;

a vehicle ground plane defined by a body of said vehicle;

mounting means for mounting said two way communication antenna and television antennas in reference to said vehicle ground plane in a manner that current flow occurs at the base of said communications antenna and said vehicle body acts as part of the antenna;

said communications antenna being carried in an upward configuration by said mounting means and said television antenna being carried in a horizontal plane by said mounting means;

a current null point created at a point along the length of said communications antenna; and said horizontal plane of said television antenna intersecting said current null point of said communications antenna in said vertically polarized radiation pattern as mounted by said mounting means.

8. The antenna of claim 7 wherein said communications antenna comprises a first vertically polarized radiating element extending upwardly from said vehicular ground plane;

a second vertically polarized radiating element spaced from said first radiating element; and a phasing coil carried between said first and second radiating elements for placing said radiating elements in phase with each other.

9. The antenna of claim 8 wherein said first radiating element is a quarter wave element and said second radiating element is a half wave element and said phasing coil effectively connecting said first and second communications radiating elements to create a communications antenna having an effective three quarter wave length.

10. A unitary multiband vehicle antenna comprising:

a first antenna lying in a vertical plane having a vertically polarized radiation pattern;

a second antenna lying in a horizontal plane having a horizontally polarized radiation pattern;

means for creating a current null point on said first antenna as said first antenna extends through said horizontal plane of said second antenna;

housing means in which said first and second antennas are carried;

said vertical plane of said first antenna and said horizontal plane of said second antenna intersecting one another at said current null point within said housing; and said current null point providing intersection of said vertical and horizontal planes with minimized cross-coupling and interference between said antennas.

11. The antenna of claim 10 including:

said housing means for housing said first and second antennas includes a widened upper portion widened generally in a horizontal plane, and a narrow supporting base adapted for attachment to said vehicle over which said widened upper portion extends;

said first antenna having a first radiating element extending upwardly through said narrow base and a second radiating element extending upwardly from the exterior of said housing at an angle within a range of about 0 to 30 degrees; and said second antenna being carried in said widened portion of said housing intersecting said current null point of said first antenna.

12. The antenna of claim 11 wherein said second antenna includes a folded generally J-shaped configuration having a first radiating element radiating in a high band of VHF frequencies, a second radiating antenna element radiating in a band of UHF frequencies, and said first and second radiating elements operating together as a third radiating element to produce radiation in a low band of VHF frequencies.

13. A unitary multiband vehicle antenna for operating over a variety of functional band frequencies from within a single compact housing, said antenna comprising:

a first antenna having a vertically polarized radiation pattern operating over a first band of frequencies;

a second antenna having a horizontally polarized radiation pattern operating over a second band of frequencies;

a housing for said first and second antennas which includes a narrow upstanding base portion adapted for attachment to said vehicle;

a widened upper portion of said housing widened with respect to said upstanding base portion generally in a horizontal plane and extending over said upstanding base portion;

said first antenna having a first radiating element lying in a vertical plane extending upwardly through said upstanding base, and a second radiating element extending upwardly from the exterior of said housing at an angle of about 0 to 30 degrees with respect to the vertical; and said second antenna being carried in said widened portion of said housing generally in a horizontal plane, said vertical plane of said first antenna and said horizontal plane of said second antenna intersecting one another at an intersection point in said housing.

14. The antenna of claim 13, wherein said second antenna includes a folded generally J-shaped configuration having a first radiating element radiating at a first resonant frequency, a second radiating element radiating at a second resonant frequency, and said first and second radiating elements operating together as a third radiating element to produce radiation at a third resonant frequency.

15. The antenna of claim 14, wherein said widened upper portion of said housing includes a curved generally boomerang shaped portion in which said second antenna having said generally J-shaped configuration is carried.

* * * * *